US005976357A

United States Patent [19]

Ström et al.

[11] Patent Number: 5,976,357

[45] Date of Patent: Nov. 2, 1999

[54] PURIFICATION OF OIL

[75] Inventors: Gunnar Ström, Uppsala; Björn Mälarstig, Brunna, both of Sweden

[73] Assignee: Alfa Laval Separation AB, Tumba, Sweden

[21] Appl. No.: 08/960,077

[22] Filed: Oct. 24, 1997

Related U.S. Application Data

[63] Continuation of application No. 08/649,715, filed as application No. PCT/SE94/01136, Nov. 28, 1994, abandoned.

[30] Foreign Application Priority Data

Nov. 29, 1993 [SE] Sweden ..... 9303961

[51] Int. Cl.[6] ..... C10G 29/20; C10G 29/22

[52] U.S. Cl. ..... 208/184; 208/179

[58] Field of Search ..... 208/184, 179–181, 208/187, 188

[56] References Cited

U.S. PATENT DOCUMENTS

| | | | |
|---|---|---|---|
| 4,033,859 | 7/1977 | Davidson et al. | 208/174 |
| 4,045,330 | 8/1977 | Avrillon et al. | 208/180 |
| 4,512,878 | 4/1985 | Reid et al. | 208/179 |
| 5,141,628 | 8/1992 | Martin et al. | 208/184 |

FOREIGN PATENT DOCUMENTS

| | | |
|---|---|---|
| 0493693 | 7/1992 | European Pat. Off. . |
| WO 90/05768 | 5/1990 | WIPO . |

*Primary Examiner*—Helane Myers
*Attorney, Agent, or Firm*—Fish & Richardson P.C.

[57] ABSTRACT

The present invention relates to a method for purification of oil which is contaminated with particles of random density and/or water. A collection polymer or polymer mixture which is insoluble in oil and liquid at room temperature and which has a density which is higher than the oil is added to and mixed with the contaminated oil. The collection polymer and the oil are separated by gravity with or without centrifugation such that the oil forms a top phase and the collection polymer or polymer mixture and the main part of the contaminants form a bottom phase. The bottom phase with the collection polymer and the contaminants is removed.

10 Claims, 3 Drawing Sheets

PURIFICATION OF OIL

Figure 1:
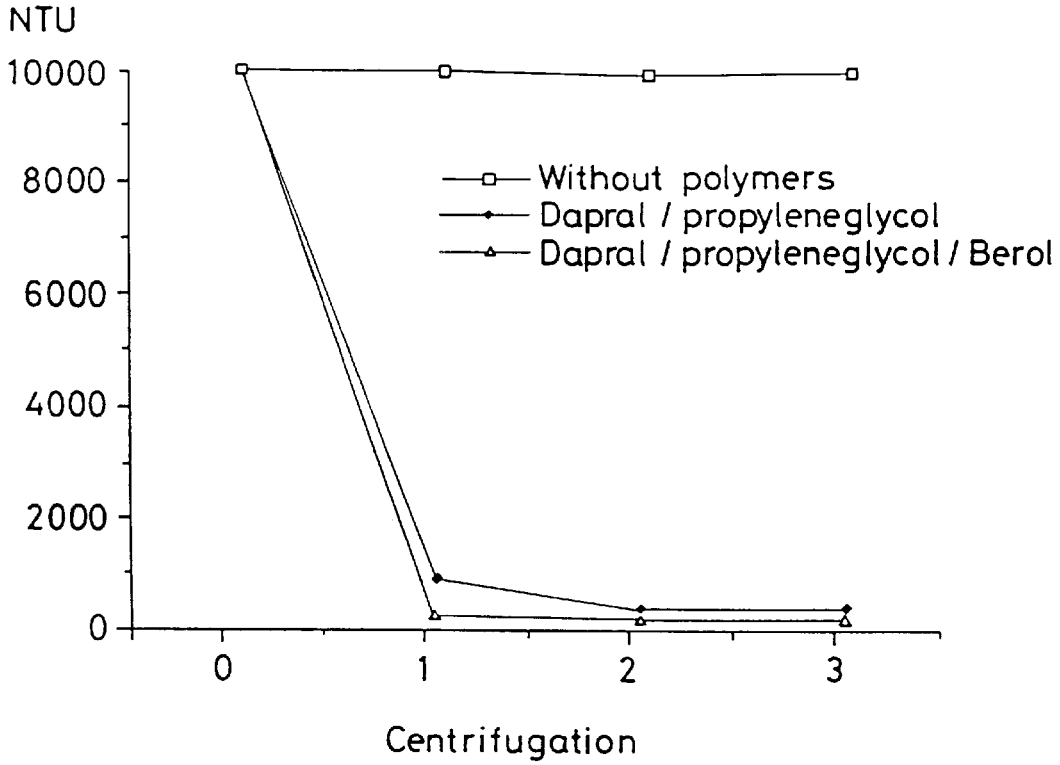

This is a continuation of application Ser. No. 08/649,715, filed Jun. 19, 1996, now abandoned, which is a 371 of PCT SE94/01136, filed Nov. 28, 1994.

The present invention relates to purification of oil, which is contaminated by particles of random density and/or water.

Pure oils are commonly used within the industry i.a. for metal working, as lubricating oils and hydraulic oils. The total consumption was estimated to be about 10 000 tons for metal working liquids, 55 000 tons for lubricating oils and 35 000 tons for hydraulic oils in Sweden 1986. Straight (pure) oils 1980 represented 7 000 tons, emulsions 3 000 tons (concentrate) and synthetics 1 000 tons (concentrate) of the metal working liquids.

Metal working liquids are used as cooling and lubricating agents at cutting working such as turning, milling, drilling, grinding and so on and in different types of plastic machining as milling, pressing and drawing.

The use of metal working liquids is the largest within iron, steel and engineering industry. The main tasks for the metal working liquids are to reduce the friction between tool and work piece by lubrication, and to remove the heat which has been formed, i.e. to cool. In the case where the lubricating ability is the most important a straight oil is chosen, while for example at higher working rates where the cooling ability is important, an oil emulsion or a synthetic one is often chosen.

The main components in the straight cutting oil are refined mineral oil and vegetable or animal oil. If necessary the fatty oils have been replaced with synthetic derivatives of the same for example methyl esters of tallow fatty acids and isopropyl oleate. In order to obtain a well working lubricating film certain EP-additives (Extreme Pressure) are also added which among all may consist of sulphur, chlorine or phosphorous compounds.

However, the properties of the oils get worse with the usage time due to contamination. Particulate contaminants in the oils are often of the type metal particles, rust, oxidation products (coke particles) from the oil. Other not desirable contaminants are water, cellulose fibres, carbon, dust and other organic particles.

In the prior art there are mainly known the following three types of purification of oil:

Mechanical filtration—the oil is brought to pass through relatively thin (about 0.25–2 mm) "paper" or through thick layers where the oil has a long way to pass. The filters consist of different fibre materials.

Electrostatic purification—the oil is pumped through an electrostatic field (10 kV) where statically charged particles will move across the flow direction of the oil. The particles then get caught on collectors of pleated paper material.

Centrifugation type centrifugal separators—in a centrifuge liquid and particles are separated, as soon as the densities are different. This makes it possible to separate particles which are lighter or heavier than the liquid.

The known methods have different advantages and disadvantages. For separation of emulsified water from oil centrifugal separator are to be preferred. Hitherto there is no satisfactory solution for separation of all kinds of particulate contaminants and water from oil.

The present invention solves the problems mentioned above by a method for purification of oil which is contaminated by particles of random density and/or water. The method is mainly characterized in that a collection polymer or polymer mixture which is insoluble in oil and which is liquid at room temperature and has a density which is higher than the oil is added to and mixed with the contaminated oil. The collection polymer and the oil are separated by gravity with or without centrifugation such that the oil forms a top phase and the collection polymer or polymer mixture and the main part of the contaminants form a bottom phase. The bottom phase with the collection polymer or polymer mixture is removed.

The word "particles" refers to all kinds of substances, cells and cell remains.

The oils to be purified may consist for example of lubricating oils, hydraulic oils, rolling oils or quench oils.

The collection polymer or polymer mixture consists of polymers with a relatively low molecular weight.

The used polymer or polymer mixture may consist of different alkylene glycols or polyalkylene glycols based on ethylene or propylene and different copolymers of ethylene oxide (EO) and propylene oxide (PO).

The choice of collection polymers depend on the actual contaminants. If the contaminating particles have a surface structure of a hydrophilic nature then a polyethylene glycol with a rather low molecular weight may be chosen (100–300). If the surface structure of the particles is mainly of hydrophobic nature then a blockpolymer of ethylene oxide (EO) or propylene oxide (PO) with a high content of PO may be used (Molecular weight 4000–8000).

The used amounts of collection polymers may be up to 1%, preferably only 1–5% of the amount of oil.

Figure 2:
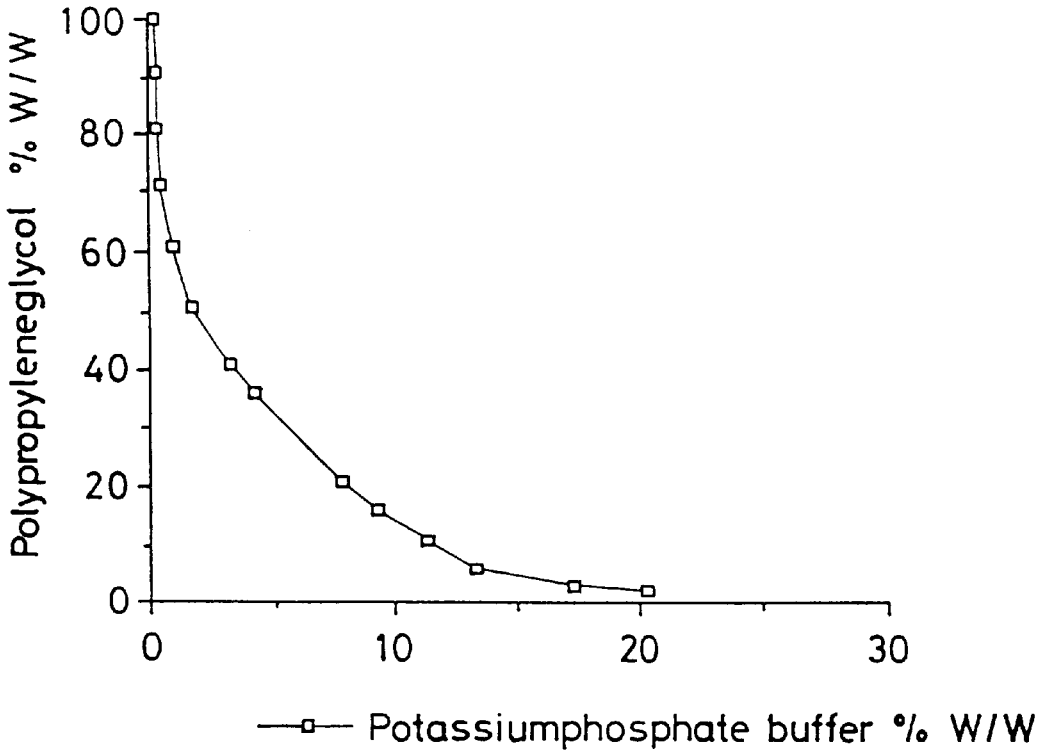

The invention will be described further with reference to the trials and drawings described below, in which FIG. 1 shows a step-by-step purification of a cutting oil with and without addition of polymers; and FIG. 2 is a phase diagram for polypropylene glycol 425 and phosphate buffer.

Figure 3:
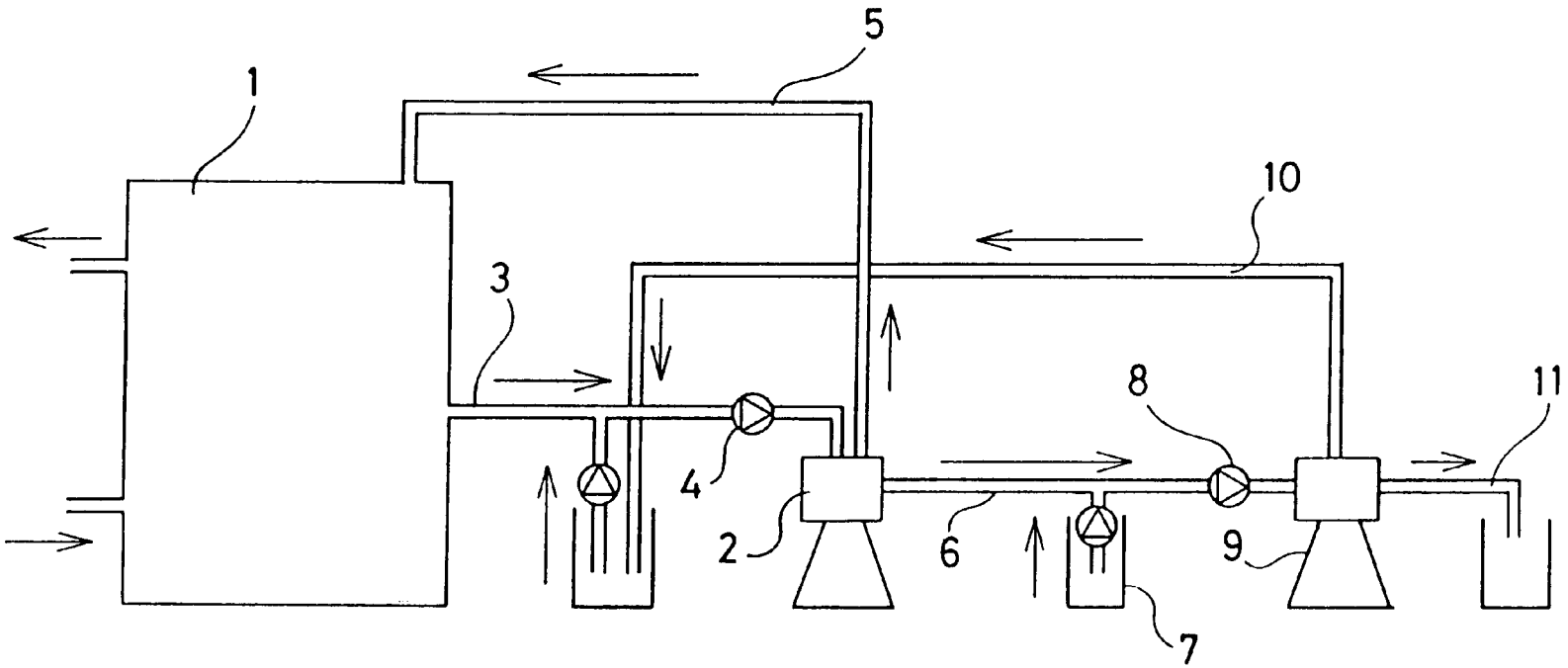

FIG. 3 Arrangement for purification of oil and regeneration of collection polymers.

TRIAL 1

Separation of Polymer Particles from Mineral Oil with Different Polymers

To a basic oil, PA 06 (Nynäs Petrolium) polymer particles with a median diameter of 4.3 $\mu$m (Expancel 051 DC) are added. The concentration of particles was measured by means of a HACH turbidimeter (Svenska Merkanto AB, Uppsala, Sweden). 8 g particle contaminated oil and 0.2 g of the polymers and polymer mixtures described in Table 1 were added to test tubes of glass containing 10 ml. Polymer/hydroxyethyl-tallow-oil-imidazoline (Berol 594) (Berol Kemi, Stenungsund, Sweden) will in the following be abbreviated as Berol 594.

A test tube containing 8 g particle-contaminated oil without added polymer and a test tube where the collection polymer was replaced by 0.2 g $H_2O$ were used as reference.

The test tubes were mixed thoroughly and centrifuged at 2 000 rpm during 2 minutes, after which 4 ml of the upper oil phase is transferred to clean trays of glass for measurement of the turbidity. The trials were carried out at room temperature.

TABLE 1

| Polymer | EO/PO | Viscosity (CSt) | Particle reduction (%) |
|---|---|---|---|
| Propylene glycol (MB Sveda Kemi) | — | 62 | 70 |

TABLE 1-continued

| Polymer | EO/PO | Viscosity (CSt) | Particle reduction (%) |
|---|---|---|---|
| Propylene glycol + Berol 594 (5:1) | — | 62 | 96 |
| Polypropylene glycol 425 (MB Sveda Kemi) | — | 80 | 95 |
| Polypropylene glycol 425 + Berol 594 | — | 80 | 97 |
| Breox 50A140 (BP, Chemicals) | 1:1 | 130 | 51 |
| Breox 50A140 + Berol 594 | 1:1 | 130 | 59 |
| Breox 50A1000 + (BP Chemicals) | 1:1 | 1000 | 66 |
| Breox 380EP + Berol 594 | 1:1 | 1000 | 74 |
| Breox 380EP + (BP, Chemicals) | 1:1 | 1250–3000 | 50 |
| Breox 380EP + Berol 594 | 1:1 | 1250–3000 | 45 |
| None | | | 21 |
| Water | | | 44 |

Addition of small amounts of non-ionic or charged polymers/tensides consisting of ethylene oxide and/or propylene oxide monomers (0.1–10%) to a straight mineral oil containing particulate contaminants results in a turbid solution which after centrifugation alternatively after static separation divides into an oil phase (top phase) and a polymer phase (bottom phase). The particles are after the separation mainly found in the polymer containing bottom phase.

As may be seen from Table 1 centrifugation only of the particle contaminated oil results in a reduction of particles of 21%. The corresponding result when adding propylene glycol and polypropylene glycol was 70 and 95%, respectively. When the two non-ionic polymers consisting of both ethylene oxide and propylene oxide (Breox 50A 140 and 50A 1000) were used the reduction of particle was 51 and 66%, respectively, and for the negatively charged (acrylic acid-grafted) polymer Breox 380EP a separation efficiency of 50% was obtained.

The mechanism for distribution of the particles in the uncharged systems is probably based on hydrophilic/hydrophobic interactions between the collection polymers and the surface structure of the particles. An addition of the positively charged polymer hydroxyethyl-tallow oil-imidazoline to the polymers resulted except from Breox 380EP in an increased separation efficiency. The best results were obtained after an addition of a positively charged polymer to propylene glycol where an increase from 70 to 96% was obtained. The corresponding increase for polypropylene glycol was 95 to 97%. The improved separation depends most likely on charge interactions between the positively charged hydroxyethyl-tallow oil-imidazoline and negative charges on the surfaces of the particles which may result in formation of micells and thereby an increased solubility of the particles in the polymer phase.

TRIAL 2

Separation of Bacteria from Mineral Oil with Different Polymers

To a rolling oil (Roll oil 450, Nynäs) bacteria cells (Pseudomonas spp) with a size of about 2 μm were added. The concentration of bacteria was measured by means of a HACH turbidity meter. 8 g bacteria contaminated oil and 0.2 g of the polymers mentioned above were added to a 10 ml test tube of glass. A test tube containing 8 g bacteria contaminated oil without any added polymer was used as reference.

The contents of the test tubes were well mixed and centrifuged at 2 000 rpm during 2 minutes, after which 4 ml of the upper oil phase was transferred to clean trays of glass for measurement of the turbidity. The trials were carried out at room temperature.

Results from the separation of bacteria cells from a mineral oil (rolling oil) with and without polymer dosing is presented in Table 2. Without any added polymers a separation efficiency of 30% was obtained after centrifugation at 2 000 rpm during 2 minutes. Corresponding results with the different polymers varied between 80 and 90%. Addition of the positively charged hydroxyethyl-tallow oil-imidazoline gave also in this trial an increased bacteria separation (86–95%) also for Breox 380EP.

TABLE 2

| Polymer | Bacteria reduction |
|---|---|
| Propylene glycol (MB Sveda Kemi) | 88.4 |
| Propylene glycol + Berol 594 | 94.2 |
| Polypropylene glycol 425 (MB Sveda Kemi) | 80 |
| Polypropylene glycol 425 + Berol 594 | 86 |
| Breox 50A140 (BP, Chemicals) | 88.4 |
| Breox 50A140 + Berol 594 | 93.2 |
| Breox 50A1000 (BP, Chemicals) | 89.7 |
| Breox 50A1000 + Berol 594 | 93.1 |
| Breox 380EP (BP, Chemicals) | 88.8 |
| Breox 380EP + Berol 594 | 90.9 |
| None | 21.5 |

TRIAL 3

Step-By-Step Purification of Particle Contaminated Cutting Oil by Means of Polymers To a particle contaminated straight cutting oil (Volvo, Skovde) 2.5% (w/w) of the following polymer mixtures were added:

12% Dapral 210 (Akzo) dissolved in propylene glycol

12% Dapral 210 (Akzo) dissolved in propylene glycol+ 3% Berol 594

The addition was carried through in 10 ml test tubes of glass. After addition the contents of the tubes were mixed thoroughly after which they were centrifuged at 2 000 rpm during 2 minutes. As a control a sample of particle contaminated cutting oil without any addition of polymer was centrifuged. After removal of the particle containing polymer rich bottom phase the particle content in the upper oil phase was determined by means of a HACH turbidimeter. The extraction procedure was repeated twice. The turbidity was determined after each of the three centrifugations. The trials were carried out at room temperature.

Purification of a particle-contaminated cutting oil with and without addition of polymer is presented in FIG. 1. The addition of polymers was carried out step-by-step in order to simulate the continuous polymer addition which may be used when using centrifugal separators. Three successive centrifugations of the cutting oil at 2 000 rpm reduced the content of particles by 1%. Addition of the polymer Dapral 210 dissolved in propylene glycol gave in the first extraction step 93% separation efficiency and after two and three extractions the separation efficiency was 98 and 99%, respectively. By including the positively charged polymer hydroxyethyl-tallow oil-imidazoline an increased separation efficiency was obtained which after three extractions was >99%.

TRIAL 4

Purification of Oil with Polymer Addition in Combination with a Centrifugal Separator on a Large Scale Polymer particles with a median diameter of 4.3 μm (Expancel 051 DC) were added to 200 liters of oil (Nynäs).

The oil was heated by means of an immersion heater to 55° C. The particle-contaminated oil was fed by way of a pump to a two-ways centrifugal separator (MMPX 304, Tetra-Laval AB, Tumba). The flow through the separator was 500 liters/hour. By way of a tube pump connected to the inlet to the separator polypropylene glycol (Mw 425) was added. The flow of collection polymer was 3 liters/hour. The concentration of particles in the effluent from the separator was measured with and without addition of polymers by means of a HACH turbidity meter.

Industrial separators are commonly used to purify mineral oils from particulate contaminants and water on a large scale. Great application areas are purification of fuel and of lubricating systems on board of ships and within the industry. Purification from particles only by means of centrifugal separator does not give a satisfactory result in many cases which means that one has been forced to combine this technique with other purification methods, e.g. filtration. Addition of small amounts of polymer to particle-contaminated mineral oil in combination with separation of the polymer phase with an industrial separator results in a dramatical increase in the efficiency of separation (Table 3).

TABLE 3

Particle concentration (NTU) in the effluent with and without an addition of polymers. The concentration in the tank at start was 1960 NTU.

| Time (min.) | Without polymer | With polymer |
|---|---|---|
| 5 | 1725 | 4.9 |
| 10 | 1465 | 2.3 |
| 15 | 1399 | 2.0 |
| 20 | 1352 | 1.4 |

Only separation at a high g-force brings as may be seen from the table a low separation efficiency (9–31%) counted on the original concentraton in the oil. Addition of 0.6% polypropylene glycol to the oil prior to the separator increased the separation efficiency dramatically as regards the particles (99.8–99.9%). The advantage of this technique of purifying oil compared to the filter technique is that the problem with clogged filter pores is avoided. Since the distribution coefficient for the particles to the bottom phase polymer is extreme it is also possible to recirculate the bottom phase polymer, which means that very large volumes of oil may be purified with small volumes of polymer.

TRIAL 5

Purification of Hydraulic Oil Contaminated by Particles by Means of Polymer Addition in Combination with Centrifugal Separation on a Large Scale A hydraulic oil (Load Way EP 220, Stat Oil) heavily contaminated with coke particles was heated to 80° C. The hydraulic oil was fed by way of a pump to a centrifugal separator (MMPX 304, Tetra Laval AB, Tumba). The flow through the separator was 500 l/h. A mixture of polypropylene glycol (MW 425) and Berol 594 (mixing ratio 5:1) was added to the feed inlet to the separator by way of a tube pump. The flow of collection polymer was 500 l/h. The concentration of particles in the effluent from the separator was measured by means of a HACH turbidity meter with and without addition of polymers.

The results from the trials with and without addition of polymer/imidazoline is given in table 4. As may be seen in the table centrifugal separation only gives a reduction of particles in the oil corresponding to about 73–78%. This reduction is probably a decrease of the amount of larger particles but a gradual increase in the number of very small particles 0,1–3 $\mu$m in the hydraulic oil. Addition of polymer/Berol 594 gives an essentially increased separation efficiency corresponding to 99.3–99.6%. With this addition a reduction of all present particle sizes takes place, i.e. also of particles of submicron size.

TABLE 4

Concentration of particles (NTU) in effeluent with and without addition of polymers. The initial concentration in the tank was 1230 NTU.

| Time (min.) | Without polymer | With polymer |
|---|---|---|
| 5 | 335 | 6.8 |
| 10 | 311 | 5.2 |
| 15 | 268 | 8.8 |
| 20 | 306 | 5.6 |

TRIAL 6

Separation of Water in Oil by Means of Polymer System 0.5 g $H_2O$ was added to a test tube containing 19.5 g oil. The content of the tube was mixed well on a shaking device for test tubes and in a ultrasonic bath until the water was well emulsified into the oil phase. The water containing oil was divided into four test tubes after which the turbidity was determined. To tube A 2.5% polypropylene glycol was added, to tube B 2.5% polypropylene glycol containing 10% Berol 594 and to the tube C 2.5% polypropyleneglycol containing 20% Dapral 210. The tubes were centrifuged together with a reference sample at 2 000 rpm during 6 minutes. After the centrifugation the turbidity in the oil phase was measured in all the tubes.

Separation of water in oil is a usual application for industrial separators. The technique may be improved considerably by additon of polymer/polymer mixtures (Table 5).

TABLE 5

Purification of oil as regards water by means of addition of polymers. The water content is given as turbidity in the oil (NTU).

| | No polymer | Polypropylene glycol | Polypropylene glycol + Berol 594 | Polypropylene glycol + Dapral 210 |
|---|---|---|---|---|
| O-sample | 2110 | 2050 | 2089 | 2167 |
| After centrifug. | 784 | 11 | 14 | 14 |
| Purifica-tion eff. (%) | 63 | 99.5 | 99.3 | 99.4 |

As may be seen in the table there is a purification efficiency obtained around 60% by using only centrifugation at 2 000 rpm during 2 minutes of oil containing very small water drops. By addition of polypropylene glycol, polypropylene glycol with addition of Berol 594 or polypropylene glycol with addition of Dapral 210 in all cases a separation efficiency >95% is obtained. The polymers which are used in this trial are all water soluble but not soluble in oil.

TRIAL 7

Regeneration of Polymer Phase by Means of Citric Acid/Citrate Buffer

To test tubes containing 10 g polypropylene glycol, (Mw 450) contaminated Expancel particles and bacteria cells there was added a 20% citric acid/citrate buffer to a final concentration of 3.3%. The relation between citric acid and citrate was 1:1. The test tubes were well mixed and centrifuged at 2 000 rpm during 2 minutes. The upper top phase rich in polypropylene glycol was analyzed by means of turbidity measurement.

Particle containing poylmer phase from oil purification may be regenerated by means of polymer two-phase-systems, where the polymer phase is the top phase and a water solution of citrate/citric acid, sodium or potassium phosphate buffer constitutes the bottom phase. In FIG. 2 there is shown a phase diagram for polypropylene glycol 425 and phosphate buffer. By dosing low concentrations of phosphate buffer in combination with a high polymer concentration there is formed, as may be seen in the figure, a system with a very small amount of bottom phase in which particulate contaminants from the polymer phase are concentrated.

Regeneration of collection polymer (polypropylene glycol 425) containing Expancel particles and bacteria cells (Pseudomonas spp) by means of a water containing polymer two-phase system consisting of citric acid/citrate buffer as a bottom phase polymer is shown in Table 6.

TABLE 6

Regeneration of collection polymer phase by means of a water containing polymer two-phase system. The particles consist of Expancel particles and bacteria cells. The particle concentration in the polymer phase is given in NTU.

| | Expancel particles | Bacteria cells |
|---|---|---|
| Particle content polymer phase prior to separation | 4790 | 2620 |
| Particle content polymer phase after separation | 420 | 170 |
| Regenerative eff. | 91 | 94 |

As may be seen in the table there a good separation efficiency 91–94% is obtained of the polymer phase after only one separation with citric acid/citrate buffer. At the addition of buffer solution to the polymer a certain part of water will be found in the polymer phase when the two phase system is formed. This water amount is very small <6% and will not effect the separation efficiency when the polymers are used for purification of mineral oils.

An arrangement for purification of oil will be described with reference to FIG. 3.

In this figure there is shown a central collection tank for contaminated oil 1. From this tank the oil is led towards a centrifugal separator 2 by way of a pipe 3. In this pipe there is a pump 4 where the oil is mixed with polymers according to the invention. The oil and the polymers are separated in the centrifugal separator and the purified oil is returned to the tank 1 by way of pipe 5. The polymers and the particles are led to a second purification step where the polymers are regenerated by way of a pipe 6. In this step there is a tank 7 for a citric acid/citrate buffer. The mixture of polymer and particles are mixed with the citric acid/citrate buffer in a further pump 8 and led to a second centrifugal separator 9. The purified polymer phase is returned to the polymer tank by way of pipe 10, while the contaminants are removed by way of pipe 11.

We claim:

1. A method for the purification of oil which is contaminated by particles having different densities from the oil, or by water or by both said particles and water, consisting essentially of the steps of adding a polymer or a plurality of polymers to the contaminated oil to form a mixture, said polymer or plurality of polymers taken from the group consisting of polyethylene glycol having a molecular weight in the range of from about 100 to about 300, ethylene oxide blockpolymer and propylene oxide blockpolymer having a molecular weight in the range of from about 4000 to about 8000, agitating the mixture, separating the mixture into two phases, namely, a top phase comprising purified oil and a bottom phase comprising the polymer or the plurality of polymers with a substantial portion of the contaminants originally present in the oil, and removing the bottom phase, and wherein the polymer or plurality of polymers are insoluble in the oil, are liquid at room temperature and have higher densities than that of the oil being purified.

2. The method according to claim 1 wherein a charged control polymer is also added with the polymer or plurality of polymers, the control polymer having affinity for the contaminants and thereby increasing the proportion of the contaminants present in the bottom phase over the proportion present in the absence of the control polymer.

3. The method according to claim 1 wherein the purified oil is further treated by additional polymer or plurality of polymers to form a further mixture, and the further mixture is agitated, is separated into two phases and the bottom phase is removed.

4. The method according to claim 1 wherein the polymer or plurality of polymers is recovered from the bottom phase.

5. The method according to claim 1 wherein a complex forming agent is added with the polymer or plurality of polymers.

6. The method according to claim 1 wherein a plurality of polymers is used, comprising a polymer, a charged control polymer and a complex forming agent.

7. The method according to claim 6 wherein the purified oil is further treated by an additional plurality of polymers comprising a polymer, a charged control polymer and a complex forming agent.

8. The method according to claim 1 wherein the separating step is performed in part by centrifugation.

9. The method according to claim 1 wherein the polymer or plurality of polymers comprises up to 10% of the amount of the oil.

10. The method according to claim 1 wherein the polymer or plurality of polymers comprises up to 5% of the amount of the oil.

* * * * *